US009446826B2

(12) United States Patent
Fuhrhop et al.

(10) Patent No.: US 9,446,826 B2
(45) Date of Patent: Sep. 20, 2016

(54) SURVIVAL AID, IN PARTICULAR FOR SWIMMERS AND FOR THOSE TAKING PART IN WATER SPORTS

(71) Applicants: Christopher Fuhrhop, Pforzheim (DE); Marius Kunkis, Karlsruhe (DE)

(72) Inventors: Christopher Fuhrhop, Pforzheim (DE); Marius Kunkis, Karlsruhe (DE)

( * ) Notice: Subject to any disclaimer, the term of this patent is extended or adjusted under 35 U.S.C. 154(b) by 0 days.

(21) Appl. No.: 14/648,863

(22) PCT Filed: Dec. 2, 2013

(86) PCT No.: PCT/EP2013/003623
§ 371 (c)(1),
(2) Date: Jun. 1, 2015

(87) PCT Pub. No.: WO2014/086471
PCT Pub. Date: Jun. 12, 2014

(65) Prior Publication Data

US 2015/0284059 A1 Oct. 8, 2015

(30) Foreign Application Priority Data

Dec. 3, 2012 (DE) ..... 20 2012 011 525 U

(51) Int. Cl.
*B63C 9/15* (2006.01)
*B63C 9/125* (2006.01)
*B63C 9/23* (2006.01)

(52) U.S. Cl.
CPC *B63C 9/155* (2013.01); *B63C 9/23* (2013.01)

(58) Field of Classification Search
CPC ..... B63C 9/00; B63C 9/01; B63C 9/02; B63C 9/04; B63C 9/18; B63C 9/23; B63C 9/155
USPC ..... 441/35–136
See application file for complete search history.

(56) References Cited

U.S. PATENT DOCUMENTS

| | | | | |
|---|---|---|---|---|
| 2,703,891 A | | 3/1955 | Mayer | |
| 2,716,245 A | | 8/1955 | Desjarlais et al. | |
| 2,886,835 A | * | 5/1959 | Moran | B63C 9/1255 441/96 |
| RE25,398 E | * | 6/1963 | Moran | B63C 9/155 441/111 |
| 3,119,132 A | | 1/1964 | Nayar | |
| 4,342,278 A | * | 8/1982 | Horan | B63B 7/08 114/345 |
| 4,747,797 A | * | 5/1988 | Hindle | B63C 9/04 114/138 |
| 5,466,179 A | | 11/1995 | Jeffrey, Sr. | |

(Continued)

FOREIGN PATENT DOCUMENTS

| | | |
|---|---|---|
| CH | 52511 A | 1/2011 |
| DE | 20215236 U1 | 4/2003 |

(Continued)

OTHER PUBLICATIONS

International Search Report issued in PCT/EP2013/003623, mailed on May 15, 2014.

*Primary Examiner* — Daniel V Venne
(74) *Attorney, Agent, or Firm* — Birch, Stewart, Kolasch & Birch, LLP

(57) ABSTRACT

A survival aid which includes an inflatable floating body provided with a compressed gas cartridge for inflating the floating body, a bag for accommodating the floating body in an uninflated state, the bag being provided with looped tabs and a securing pin which extends through the looped tabs whereby upon the removal of the securing pin from the looped tabs, the floating body is released from the bag in an inflated state.

20 Claims, 4 Drawing Sheets

(56) References Cited

U.S. PATENT DOCUMENTS

| | | | | |
|---|---|---|---|---|
| 5,839,931 | A | 11/1998 | Shieh | |
| 5,839,932 | A | 11/1998 | Pierce et al. | |
| 6,080,027 | A * | 6/2000 | Rodemann | B63B 43/12 441/38 |
| 2006/0270290 | A1 | 11/2006 | Tellew | |
| 2010/0112880 | A1 | 5/2010 | Aschauer | |

FOREIGN PATENT DOCUMENTS

| | | | |
|---|---|---|---|
| DE | 102009028016 | A1 | 1/2011 |
| DE | 20 2012 007 334 | U1 | 10/2012 |
| FR | 2761045 | A1 | 9/1998 |

* cited by examiner

SURVIVAL AID, IN PARTICULAR FOR SWIMMERS AND FOR THOSE TAKING PART IN WATER SPORTS

TECHNICAL FIELD OF THE INVENTION

The invention relates to a survival aid, in particular for swimmers and those practising water sports, comprising an inflatable floating body, according to the preamble of claim 1.

PRIOR ART

DE 20 2012 007 334 U1 discloses a generic survival aid. The survival aid described in this document consists of, inter alia, an inflatable floating body, a compressed gas cartridge coupled to the inflatable floating body by means of a coupling member, and a bag which has a cover and into which the floating body is folded up when not inflated. The bag comprises two walls (referred to as front and back walls), the upper edges of which surround the opening of the bag. In the operational idle state, the opening is closed by the cover.

In the initial state, the gas path from the compressed gas cartridge to the inner space of the floating body is blocked. The coupling member has, however, a mechanism for unblocking the flow which comprises an actuating element. If said actuating element (for example a lever) is actuated, the mechanism for unblocking the flow (in general by destroying the closure cap of the compressed gas cartridge) unblocks the gas path. The user can use a release cord to actuate the actuating element, the first end of said cord being connected to the actuating element.

The result is a very light-weight and compact survival aid which can be worn around the user's waist by means of a type of belt. In emergencies, for example when the swimmer gets cramp, he pulls on the release cord and the floating body unfolds, without any further action required, out of the bag opening as a result of it filling with compressed gas, such that a floating body is provided to which the user, for example the swimmer, can hold on. This provides a simple way of bridging the time it takes for the swimmer to recover or for help to arrive. The generic survival aid is both very effective and tried and tested.

OBJECT OF THE INVENTION

Proceeding from this prior art, the object of the invention is to improve a generic survival aid so as to better secure it against accidental opening of the bag and/or accidental actuation of the actuating element. Improved security of this kind can be particularly advantageous if the survival aid is used when surfing, riding waves or kite surfing.

This object is achieved by a survival aid having the features of claim 1.

The basic structure of the survival aid is as described in DE 20 2012 007 334 U1, and therefore reference is hereby explicitly made to the disclosure of said document. According to the invention, looped tabs extend from the upper edges of the first and second walls of the bag (referred to as the front wall and rear wall in the category-defining document DE 20 2012 007 334 U1), through which looped tabs a securing pin extends when in the idle state. A pull element connected to the actuating element of the coupling member extends towards said securing pin and is connected to the securing pin, preferably substantially in the centre thereof, in a tension-proof manner. A serial actuation process is initiated by axially removing the securing pin from the looped tabs: the securing pin is first removed from all the looped tabs, as a result of which the opening is opened, or, if an additional cover is provided, which is the preferred case, a "pre-open state" of the bag is reached. Only after the pin has been completely removed from the looped tabs can the pull element be subjected to tensile stress, so that the actuating element is actuated by additional pulling on the securing pin. Although it is just as simple to actuate the survival aid of this kind as it is to actuate the survival aid of the prior art (which only requires a single linear pulling motion), inadvertent opening of the bag or inadvertent actuation is practically ruled out.

Preferred embodiments of the invention can be found in the dependent claims and in the embodiment described in more detail hereinafter with reference to the figures.

The invention is explained in more detail on the basis of a preferred embodiment and with reference to the drawings, in which:

BRIEF DESCRIPTION OF THE DRAWINGS

FIG. 5 shows the configuration in FIG. 4 once the cover has been folded in.

DESCRIPTION OF PREFERRED EMBODIMENTS

Figure 1:
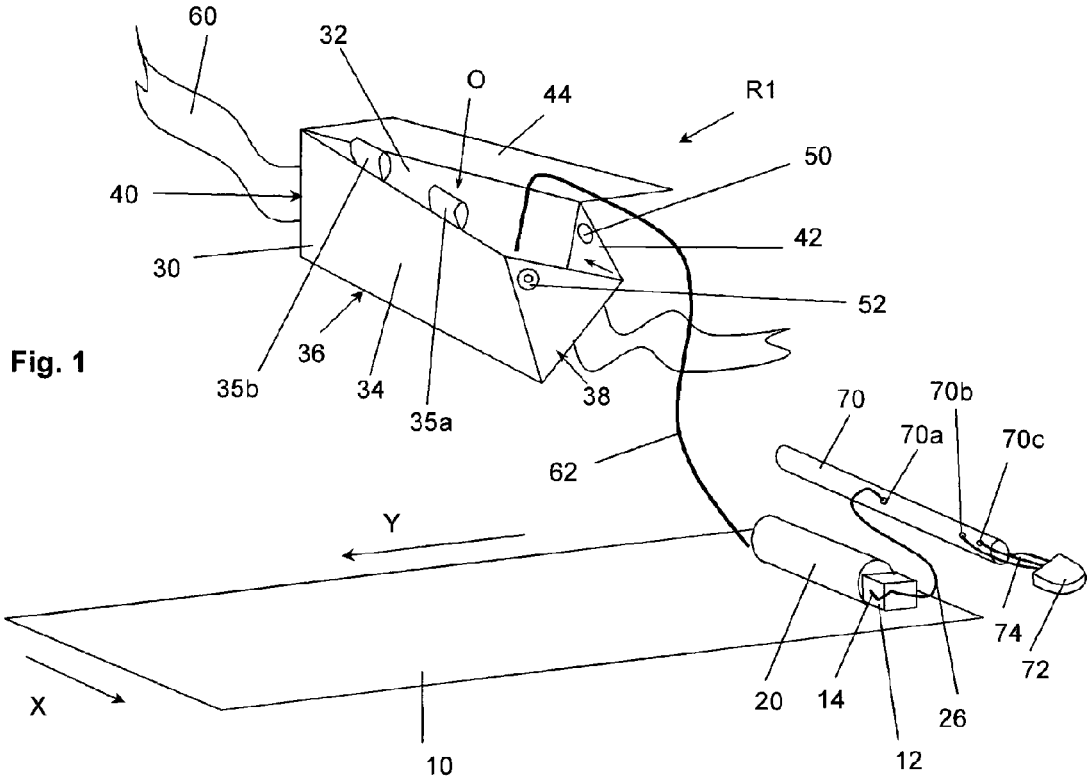
FIG. 1 shows all the components of a survival aid according to the invention.
Figure 2:
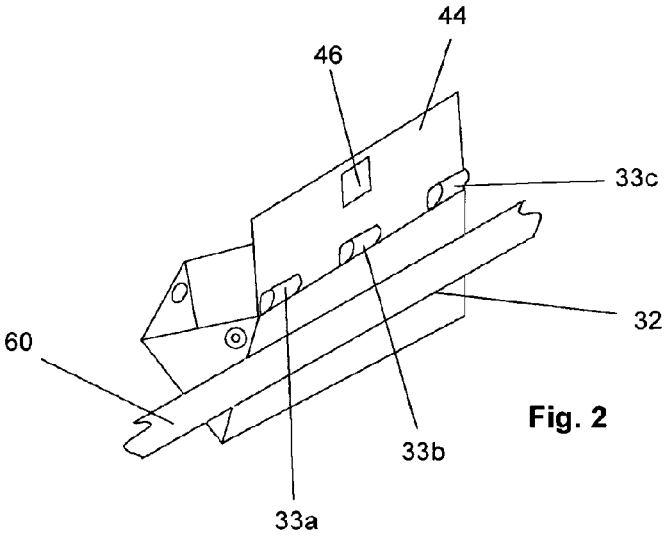
FIG. 2 shows the bag from FIG. 1 from direction R1.
Figure 3:
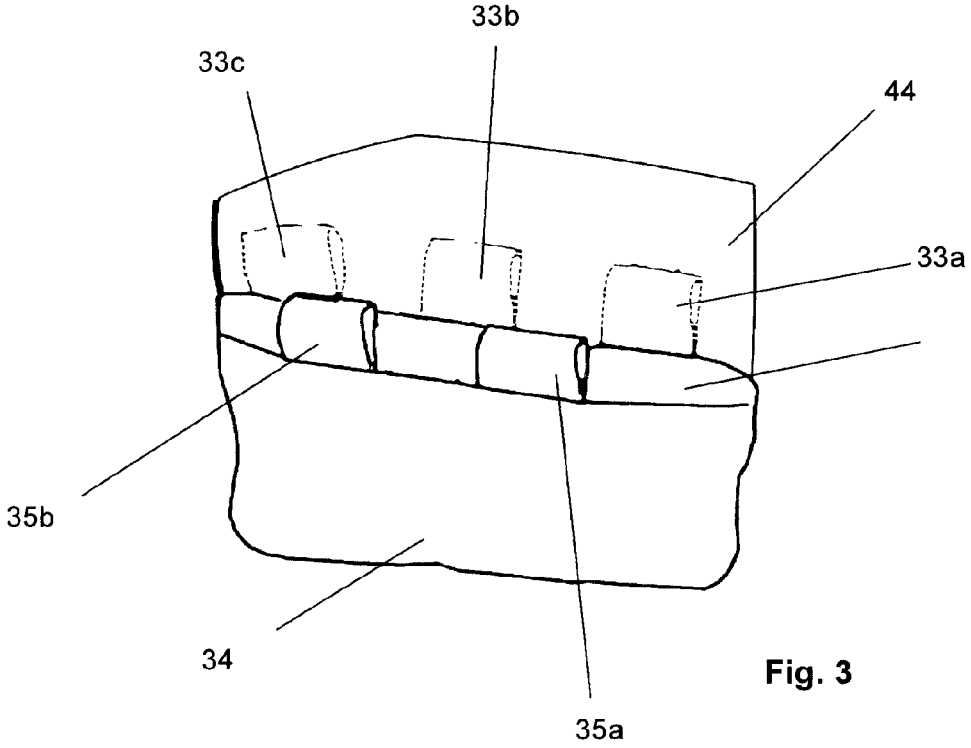
FIG. 3 shows the bag from FIG. 1 after the floating body has been folded up into the bag.
Figure 4:
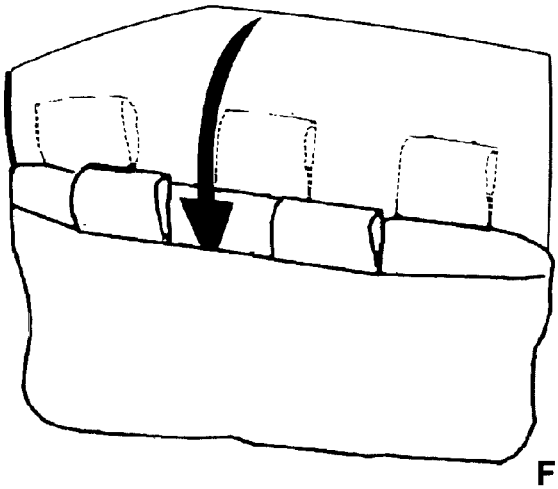
FIG. 4 shows the configuration in FIG. 3, indicating how the cover is folded up into the bag.

FIG. 1 shows all the components of the described preferred embodiment of the survival aid. This survival aid substantially consists of three parts, specifically a floating body 10, to which a compressed gas cartridge 20 can be coupled, a bag 30 and a securing pin 70. The floating body 10 and bag 30 are interconnected by means of a connecting cord 62. Said connecting cord is preferably approximately 60 cm in length.

The floating body will be discussed first:

The floating body is elongate, i.e. its length in the y direction is greater than its width in the x direction. The dimensions (including edges) are preferably the following: length approximately 70 cm, width approximately 20 cm, so that the inflated floating body has a volume of approximately 9 liters. The floating body can consist of either a film-like material or fabric. The coupling member 12 is rigidly and tightly connected to the floating body, and the aforementioned compressed gas cartridge 20 can be screwed into said coupling member (FIG. 1 shows the screwed-in state). In particular, any commercially available, small $CO_2$ compressed gas cartridge can be used as the compressed gas cartridge, as is used for example in home beer taps. When in the idle state, the closure cap of the $CO_2$ compressed gas cartridge is closed so that the gas path between the $CO_2$ compressed gas cartridge 20 and the inner space of the floating body 10 is blocked. A pull cord 26 is provided which pivots an actuating element, which is a lever 14 in the embodiment shown, when a corresponding tensile stress is applied, as a result of which said lever actuates a spindle in the coupling member 12, which punctures the closure cap of the $CO_2$ compressed gas cartridge 20, therefore destroying it. This technique is well-known in the field of life jackets and does not need to be explained in detail here. In order to stow the floating body 10 in the bag 30 (described below), the floating body is preferably folded in the y direction in the form of a concertina.

The pull cord 26 which forms the pull element is, in the embodiment shown, an end portion of a cord which first extends through a first hole 70*a* located substantially in the centre of the securing pin 70. The cord extends from this first hole 70*a* through additional holes (two parts 70*b*, 70*c* in the embodiment shown) and is arranged at one end of the securing pin in loops which carry a grip element 72. The loops of the cord which carry the grip element form a flexible connection 74 which connects the securing pin 70 to the grip element 72. The provision of such a flexible connection 74 is very advantageous since a rigidly protruding grip element could, on the one hand, get slightly damaged, and on the other hand would constitute a risk of injury. The cord can be held on the securing pin by additional means, for example heat shrink tubing, said means however not being shown for reasons of clarity. It is preferable, but not compulsory, for the pull cord 26 and the flexible connection 74 to each be portions of a common cord. A signal device in the form of a battery-operated light and/or in the form of a signal whistle (not shown) can be arranged in the grip element 72.

The bag 30 will now be described:

The bag comprises four portions, specifically a first (rear) wall 32, a second (front) wall 34, a cover 44 and a substantially V-shaped connecting element 42. The first wall 32, second wall 34 and cover 44 can in principle be produced from one blank. However, it is also possible for each portion to use a separate blank and for these blanks to be interconnected, in particular sewn together. The first wall 32 and the second wall 34 surround a receiving space and are in this case directly interconnected along a base 36 and along a side, referred to here as the second side 40. The first and second walls are also interconnected by means of a first side 38. This first side 38 is formed by the aforementioned connecting element 42, which is connected to the first wall 32 and to the second wall 34. This thus forms an opening O which extends from the first side 38 to the second side 40 and is opposite the base 36. The cover 44 extends from the upper edge of the first wall 32. A press stud 50 and a mating press stud 52 are fastened to the connecting element 42 and in such a way that their operative faces point outwards when in the state shown in FIG. 1, i.e. when the connecting element 42 is folded outwards. In this case, the press stud 50 and the mating press stud 52 are each located near the upper edge of the first wall 32 or of the second wall 34, respectively. In the state shown in FIG. 1, there is therefore an unfolded, enlarged first side 38 and an opening O having an opening angle of more than 0°. If the connecting element 42 is folded inwards (i.e. in the direction of the arrow) and the press stud and mating press stud are interconnected, the first side is reduced in size, virtually to a line, in accordance with the second side 40. A hook-and-loop element (not shown) is fastened to the inner side of the second wall 34 and a mating hook-and-loop element 46 is fastened to the outer side of the cover 44. A fastening belt 60 is held on the outer side of the first wall 32. Arranged on the front ends of said belt 60 are a clasp and a mating clasp (not shown), in particular consisting of plastics material like that often used for rucksacks, for example. Therefore the bag can be worn, in particular around the waist, by means of the belt.

Looped tabs extend from each of the upper edges of the two walls 32, 34, i.e. the edges which are adjacent to the opening O, wherein the looped tabs extending from the first wall 32 are referred to as the first looped tabs 33*a* to 33*c* and the looped tabs which extend from the second wall 34 are referred to as the second looped tabs 35*a* and 35*b*. In the embodiment shown, three looped tabs extend from the first wall 32 and two looped tabs extend from the second wall 34. In principle, it is necessary for at least one looped tab to extend from one wall and at least two looped tabs to extend from the other wall, an odd number of looped tabs being preferred. In the embodiment shown, the first (rear) wall is the wall which bears more looped tabs than the other wall (i.e. the second, front wall in this case); this could, however, be the other way round. As will be seen below in particular with reference to FIGS. 3 to 8, the looped tabs are arranged so as to be offset in such a way that they are in a row, i.e. a kind of "zip", when the looped tabs are pivoted towards one another. This means that every second looped tab is then positioned between two first looped tabs, the central first looped tab (the looped tab 33*b*) is positioned between the two second looped tabs and the first looped tabs 33*a* and 33*c* positioned at the edge are each adjacent to a second looped tab. All the looped tabs are formed as hemmed strips of fabric, i.e. as loops.

Figure 5:
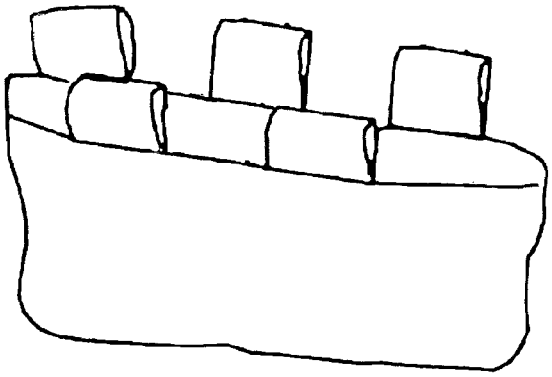
Figure 6:
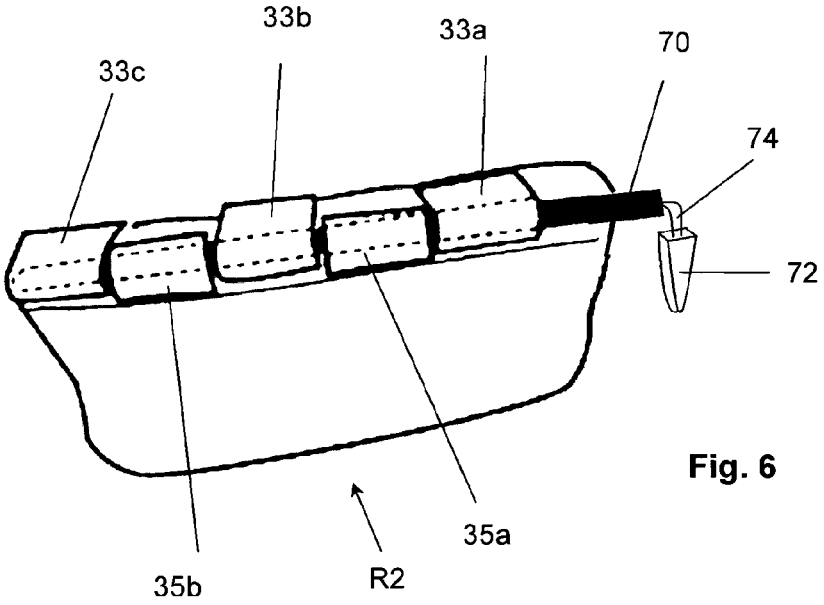
FIG. 6 shows the configuration in FIG. 5 once the securing pin has been threaded through the looped tabs.
Figure 7:
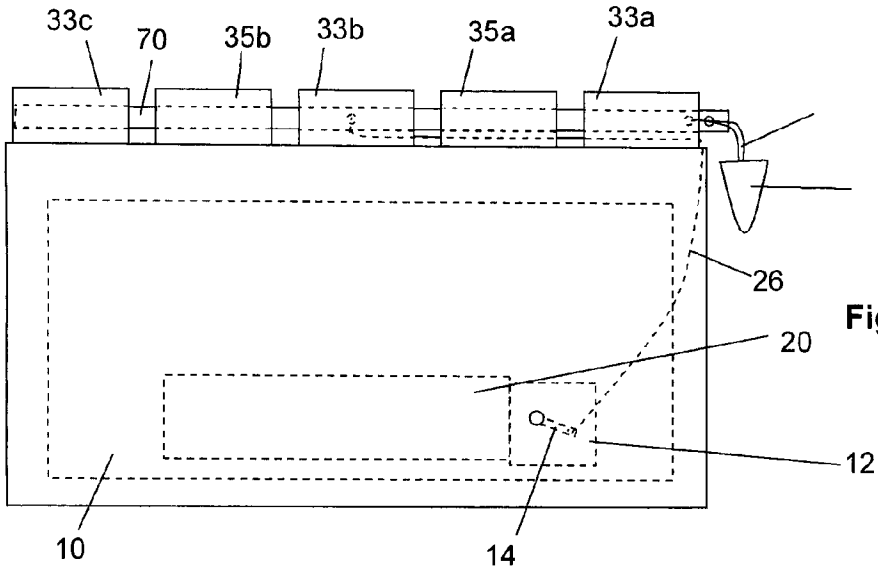
FIG. 7 shows the configuration in FIG. 6 from viewing direction R2.

The transition from the state shown in FIG. 1 to the use state shown in FIG. 6 (also referred to as the idle state), in which the coupling member 12 is in its initial state, occurs as follows: the uninflated floating body 10 is rolled or preferably folded in the y direction, and then inserted into the inner space of the bag 30, i.e. between the front wall 32 and the rear wall 34. Depending on the specific geometric design, another second fold may be necessary in the x direction in this case. The connecting element 42 is then folded inwards and the press stud 50 and mating press stud 52 are fastened to one another so that the first side 38 has a smaller depth. The cover is then inserted (FIG. 4) so as to be positioned between the floating body package and the second wall such that the hook-and-loop element and the mating hook-and-loop element mutually engage (FIG. 5). The last two steps mentioned can also be carried out in the opposite sequence. Finally, the securing pin 70 is inserted through the looped tabs until the state shown in FIG. 6 is reached. Due to the fact that the pull cord 26 is connected to the securing pin in the centre thereof, the pull cord is retracted into the looped tabs along with the securing pin, such that it is not accessible from the outside and in particular so that it cannot get caught anywhere. The length of the pull cord is such that the pull cord is completely retracted when the securing pin 70 is inserted. However, as soon as the securing pin is completely removed from all the looped tabs, said cord can be subjected to tensile stress. This geometry is clearly shown in FIGS. 7 and 8.

Figure 8:
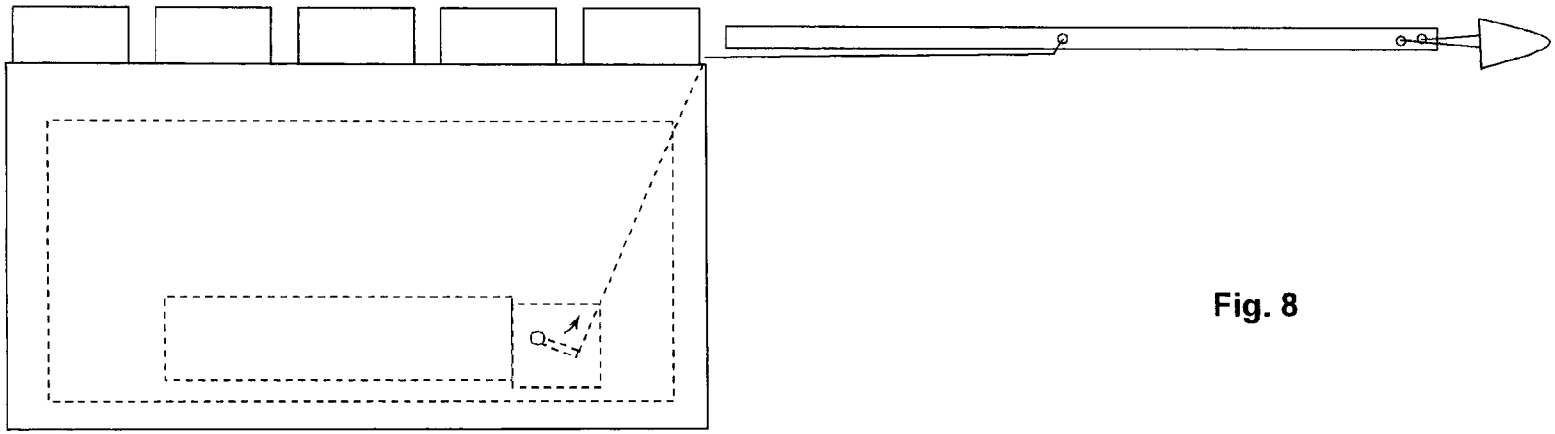
FIG. 8 shows the configuration in FIG. 7 once the securing pin has been removed from the looped tabs.

When actuating the survival aid, the securing pin 70 is removed from the looped tabs by means of the grip element 72 in a linear pulling motion. Once said pulling motion has finished, the pull cable is subjected to tensile stress and actuates the lever 14 (FIG. 8). If the pull cord 26 (i.e. the pull element) is connected to the securing pin substantially in the centre thereof, as shown, this has the advantage that a minimum actuating path can be achieved. When the pull cord 26 is subjected to tensile stress, the outer side of the cover 44 is still connected to the inner side of the second wall 34 due to the hook-and-loop connection, as a result of which the floating body is prevented from being pulled out of the bag 30 before the actuating element of the coupling member (i.e. the lever 14) has been actuated by the pull cord. Therefore, the cover 44 does not only have an additional protective function, but also plays an important role in the triggering process. Using a hook-and-loop fastener for the releasable connection between the cover and the second wall constitutes a preferred option, however use of a different closure means which opens when a specific force is applied would also be possible. A pair of press studs is given here as an example of this.

When it unfolds, the floating body opens both the hook-and-loop connection between the cover and the second wall 34 and the connection, formed by the press stud and the mating press stud, of the first side 38, which unfolds immediately thereafter, thus increasing the opening angle of the opening as described in DE 20 2012 007 334 U1. As a result of this, the longitudinal section of the bag assumes the shape of a skewed trapezium, i.e. the bag widens towards the top and the floating body can unfold upwards without hindrance. The now inflated floating body 10 then leaves the bag completely, but is held by the connecting cord 62 to the bag and therefore to the person wearing the bag, so that the floating body 10 is at their immediate disposal.

LIST OF REFERENCE NUMERALS

10 floating body
12 coupling member
14 lever
20 compressed gas cartridge
26 pull cord
30 bag
32 first wall
33*a-c* first looped tab
34 second wall
35*a-c* second looped tab
36 base
38 first side
40 second side
42 connecting element
44 cover
46 hook-and-loop element
50 press stud
52 mating press stud
60 fastening belt
62 connecting cord
70 securing pin
70*a-c* hole
72 grip element
74 flexible connection

The invention claimed is:

1. A survival aid for use in conjunction with water activities which comprises:

an inflatable floating body including a coupling member adapted to be coupled to a compressed gas cartridge and defining a gas path from the compressed gas cartridge to an inner space of the inflatable floating body, said coupling member being provided with an actuating element, a bag for accommodating the inflatable floating body in a folded up or rolled up uninflated state, said bag having a first wall, a second wall and a base for connecting the first and second walls, and at least one side which extends from the base and connects the first and second walls, defining an opening opposite to the base, at least two spaced apart first looped tabs which extend from an upper edge of the first wall, away from the base, and at least one second looped tab which extends from an upper edge of the second wall, away from the base, said looped tabs extending from said first and second walls being staggered, relative to each other, whereby when the opening of the bag is closed, the looped tabs from the first and second walls are in alignment, a securing pin connected to the actuating element via a pull element and adapted to extend through the looped stabs when the inflatable floating body is disposed in the bag, whereby the removal of the securing pin from the looped tabs engage the actuating element associated with the compressed air cartridge, enabling the floating body to be released from the bag in an inflated state.

2. The survival aid according to claim 1, wherein an opening angle of the opening is larger than 0° when the floating body is inflated.

3. The survival aid according to claim 2, wherein the first side can be stretched, folded or opened, at least in the region adjacent to the opening, such that the opening angle of the opening can be increased.

4. The survival aid according to claim 1, wherein closure elements are provided on the side, said closure elements being adapted to open upon the inflation of the floating body.

5. The survival aid according to claim 4, wherein the closure elements are at least one pair of press studs.

6. The survival aid according to claim 2, wherein the at least one first side connects the first and second walls.

7. The survival aid according to claim 1, wherein a cover extends from either the first wall or the second wall to close the opening.

8. The survival aid according to claim 7, wherein at least one closure element is provided on the cover and at least one mating closure element is provided on the inner side of the first or second wall.

9. The survival aid according to claim 8, wherein the closure element and the mating closure element form a hook-and-loop fastener.

10. The survival aid according to claim 1, wherein the first wall and the second wall make direct contact, at least at the base.

11. The survival aid according to claim 1, wherein the pull element is connected to the securing pin, substantially at the center thereof.

12. The survival aid according to claim 11, wherein the pull element extends through a hole in the securing pin.

13. The survival aid according to claim 1, wherein a grip element is coupled by a flexible connection to an end of the securing pin.

14. The survival aid according to claim 13, wherein the pull element and the flexible connection form portions of a common cord.

15. The survival aid according to claim 1, wherein the first and second walls are provided with three first looped tabs and two second looped tabs, respectively.

16. The survival aid according to claim 3, wherein the first side is designed as a connecting element which connects the first and second walls.

17. The survival aid according to claim 4, wherein the first side is designed as a connecting element which connects the first and second walls.

18. The survival aid according to claim 5, wherein the first side is designed as a connecting element which connects the first and second walls.

19. The survival aid according to claim 2, wherein a cover extends from either the first wall or the second wall and is used to close the opening.

20. The survival aid according to claim 3, wherein a cover extends from either the first wall or the second wall and is used to close the opening.

* * * * *